US011807029B2

(12) United States Patent
Rauch et al.

(10) Patent No.: US 11,807,029 B2
(45) Date of Patent: Nov. 7, 2023

(54) METHOD FOR PRODUCING AN OPTICALLY VARIABLE SECURITY ELEMENT

(71) Applicant: GIESECKE+DEVRIENT CURRENCY TECHNOLOGY GMBH, Munich (DE)

(72) Inventors: Andreas Rauch, Ohlstadt (DE); Tobias Sattler, Holzkirchen (DE); Winfried Hoffmuller, Bad Tolz (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 37 days.

(21) Appl. No.: 17/615,796

(22) PCT Filed: May 29, 2020

(86) PCT No.: PCT/EP2020/025253
§ 371 (c)(1),
(2) Date: Dec. 1, 2021

(87) PCT Pub. No.: WO2020/244806
PCT Pub. Date: Dec. 10, 2020

(65) Prior Publication Data

US 2022/0314681 A1 Oct. 6, 2022

(30) Foreign Application Priority Data

Jun. 6, 2019 (DE) ..... 10 2019 003 947.5

(51) Int. Cl.
*B42D 25/324* (2014.01)
*B42D 25/373* (2014.01)
(Continued)

(52) U.S. Cl.
CPC ..... *B42D 25/324* (2014.10); *B42D 25/373* (2014.10); *B42D 25/425* (2014.10); *B42D 25/445* (2014.10)

(58) Field of Classification Search
CPC ..... B42D 25/324
See application file for complete search history.

(56) References Cited

U.S. PATENT DOCUMENTS 4,163,570 A * 8/1979 Greenaway ..... G11B 7/0033 283/67
5,760,961 A * 6/1998 Tompkin ..... G03H 1/0252 359/566
(Continued)

FOREIGN PATENT DOCUMENTS

CA 2935427 A1 8/2015
CA 3090206 A1 8/2019
(Continued)

OTHER PUBLICATIONS

International Search Report and Written Opinion from corresponding PCT Application No. PCT/EP2020/025253, dated Sep. 8, 2020.
(Continued)

*Primary Examiner* — Kyle R Grabowski
(74) *Attorney, Agent, or Firm* — WORKMAN NYDEGGER

(57) ABSTRACT

A method for manufacturing an optically variable security element, so that for a viewer of the security element, a first color impression is created through the combination of at least the color effects of a first embossing lacquer layer and the coating, and a second, different color impression is created through the combination of the color effects of at least the first embossing lacquer layer, a second embossing lacquer layer and a coating.

15 Claims, 5 Drawing Sheets

(51) Int. Cl.
*B42D 25/425* (2014.01)
*B42D 25/445* (2014.01)

(56) References Cited

U.S. PATENT DOCUMENTS

| | | | | |
|---|---|---|---|---|
| 6,060,143 | A * | 5/2000 | Tompkin | G06K 19/06046 428/209 |
| 9,248,689 | B2 | 2/2016 | Hoffmuller et al. | |
| 9,459,385 | B2 * | 10/2016 | Brehm | B42D 25/29 |
| 9,734,735 | B2 | 8/2017 | Fuhse et al. | |
| 10,029,506 | B2 | 7/2018 | Fuhse | |
| 11,155,112 | B2 | 10/2021 | Brehm et al. | |
| 2008/0239216 | A1 * | 10/2008 | Miyamoto | B42D 25/328 349/113 |
| 2008/0258456 | A1 * | 10/2008 | Rahm | B42D 25/29 283/85 |
| 2011/0115212 | A1 | 5/2011 | Hoffmuller et al. | |
| 2015/0258838 | A1 | 9/2015 | Fuhse | |
| 2015/0352887 | A1 * | 12/2015 | Holmes | B42D 25/00 427/7 |
| 2016/0023495 | A1 | 1/2016 | Fuhse et al. | |
| 2021/0031553 | A1 | 2/2021 | Brehm et al. | |

FOREIGN PATENT DOCUMENTS

| | | | | |
|---|---|---|---|---|
| CN | 102164755 | A | 8/2011 | |
| DE | 102014001842 | A1 * | 8/2015 | B32B 15/00 |
| DE | 102014001842 | A1 | 8/2015 | |
| DE | 102016010616 | A1 | 3/2018 | |
| DE | 102018103236 | A1 | 8/2019 | |
| EP | 1879154 | A2 | 1/2008 | |
| EP | 3466711 | A1 | 4/2019 | |
| WO | 2014/060089 | A2 | 4/2014 | |
| WO | 2014/121908 | A1 | 8/2014 | |
| WO | 2015117765 | A1 | 8/2015 | |

OTHER PUBLICATIONS

German Search Report and Written Opinion from corresponding DE Application No. 102019003947.5, dated Nov. 21, 2019.

* cited by examiner

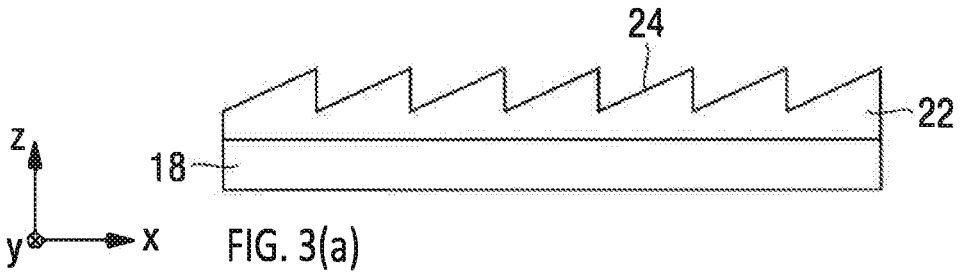
FIG. 3(a)
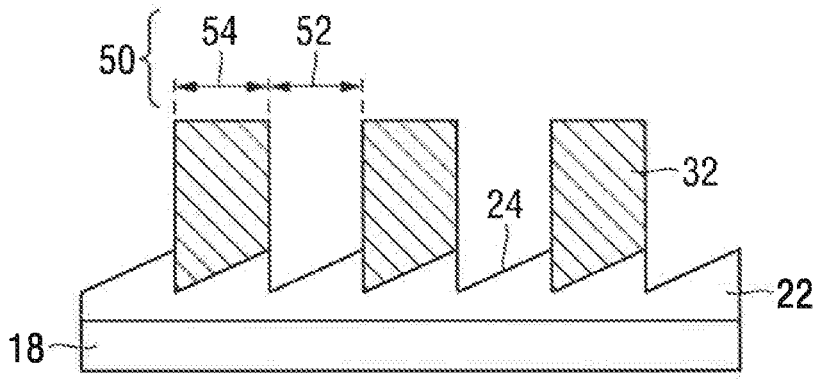
FIG. 3(b)
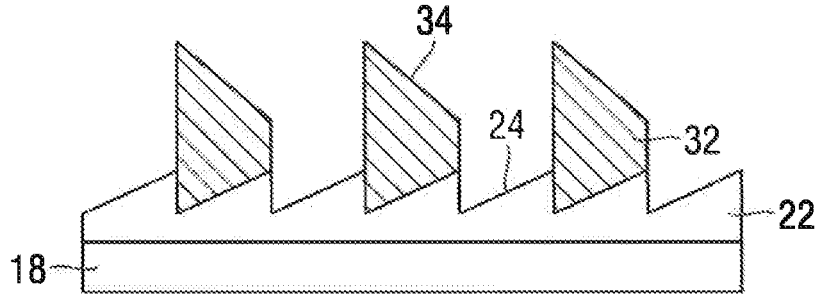
FIG. 3(c)
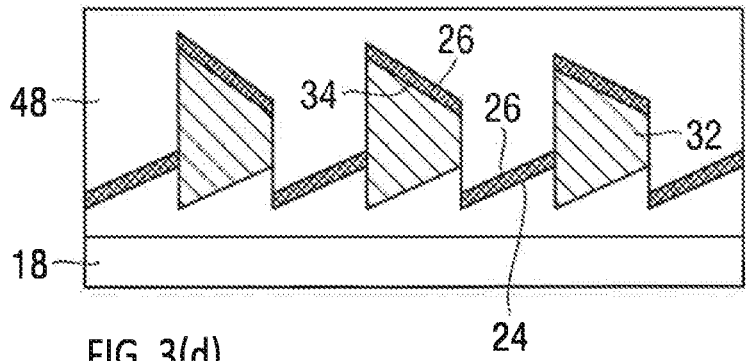
FIG. 3(d)
Fig. 3

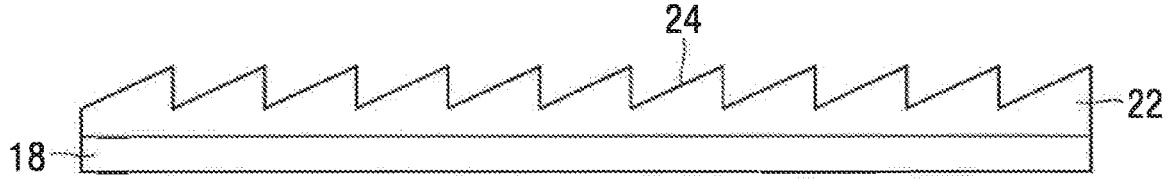
FIG. 6(a)
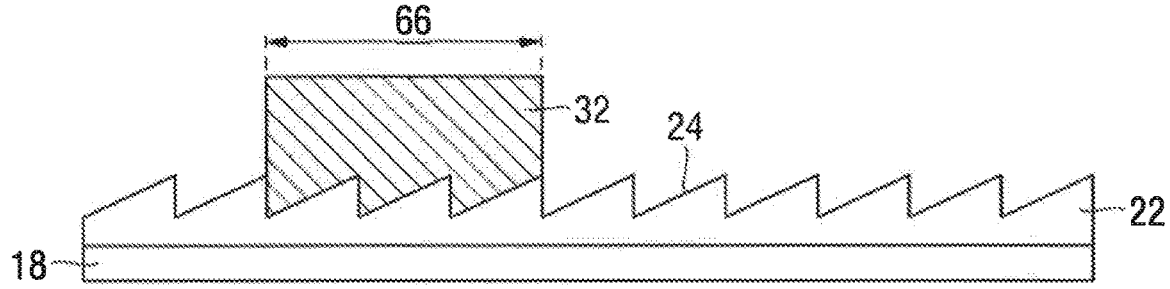
FIG. 6(b)
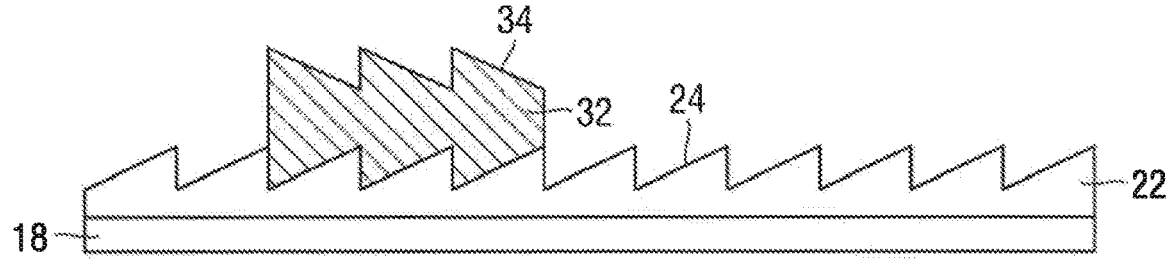
FIG. 6(c)
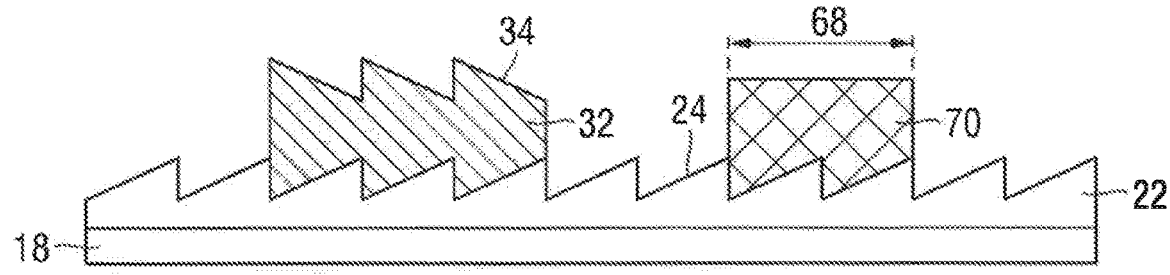
FIG. 6(d)
Fig. 6

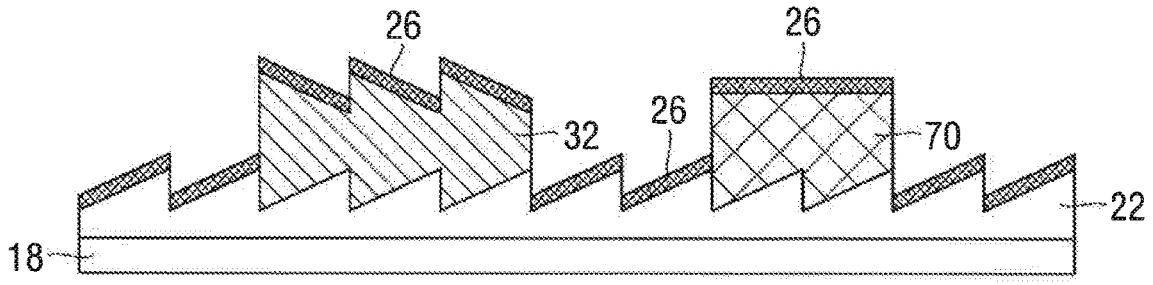
FIG. 6(e)
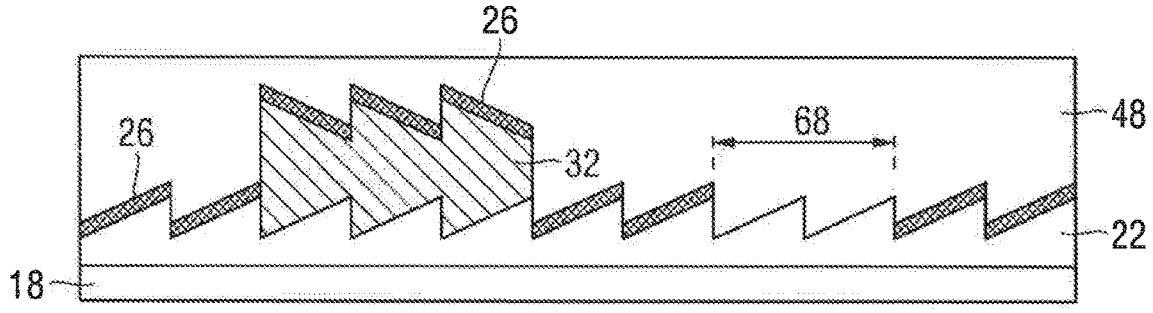
FIG. 6(f)
Fig. 6
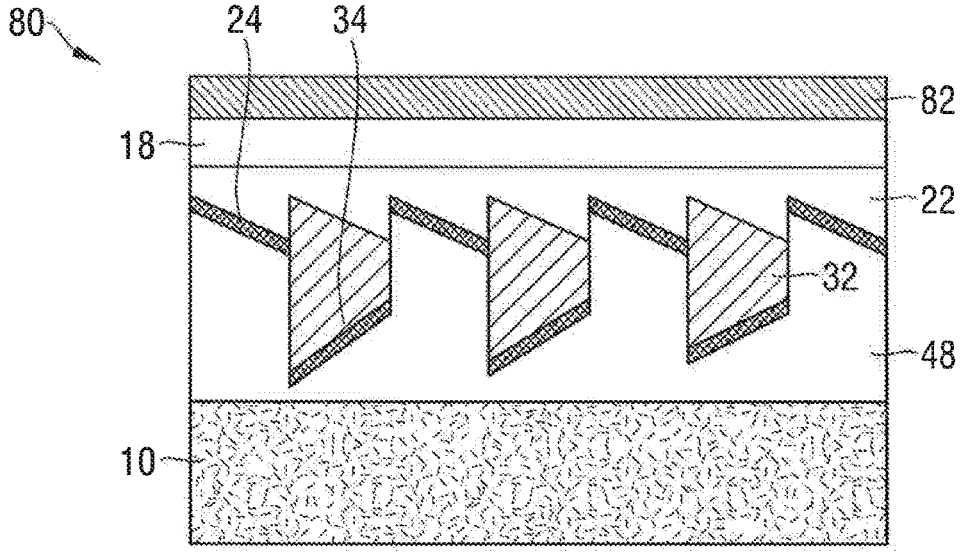
Fig. 7

METHOD FOR PRODUCING AN OPTICALLY VARIABLE SECURITY ELEMENT

BACKGROUND

The invention relates to a method for manufacturing an optically variable security element.

Data carriers, such as value documents or identity documents, but also other value objects, such as branded articles for example, are often supplied for securing purposes with security elements which permit a verification of the authenticity of the data carrier and which at the same time serve as protection from unauthorized reproduction. The security elements can be configured, for example, in the form of a security thread embedded in a banknote, a cover foil for a banknote with a hole, an applied security strip, a self-supporting transfer element or also in the form of a feature region printed directly onto a value document.

A special role in authentication assurance is played by security elements with viewing angle-dependent effects because these cannot be reproduced even with the most modern copying devices. The security elements are equipped for this purpose with optically variable elements which convey a different image impression to the viewer from different viewing angles, showing, for example, a different color impression or brightness impression and/or a different graphic motif depending on the viewing angle. In the prior art, for example, movement effects, pumping effects, depth effects or flip effects are described as optically variable effects, which are implemented with the aid of holograms, microlenses or micromirrors.

The document EP 1 879 154 A2 discloses a method for manufacturing a security element for a security paper or value document with a substrate which is equipped with a coating comprising two layers. The method comprises the steps of applying a first layer to the substrate, applying at least one second layer to the first layer, wherein the first layer is not fully cured before applying the second layer, embossing at least one layer of the coating and curing the coating.

The document WO 2014/060089 A2 relates to an optically variable area pattern with a carrier which has a first and a second area region, wherein the two area regions are configured such that the first area region has a first view that appears to be curved in a first spatial angle range and the second area region presents a second view that appears to be curved in a second spatial angle range, which is different from the first spatial angle range.

An optically variable area pattern is known from the publication WO 2014/121908 A1 which has two partial regions with reflection elements, wherein the reflection elements of the first partial region on the one hand and the reflection elements of the second partial region on the other hand reflect incident light in different reflection directions. The first partial region is so covered with a first glazing ink layer that a viewer, upon a change of the viewing angle at which the viewer views the optically variable area pattern, sees the first partial region glow in a first color upon reaching a first viewing angle, and the second partial region glow in a second color that is different from the first color upon reaching a second viewing angle.

SUMMARY

Proceeding from this, it is the object of the invention to specify a simple and cost-effective method for manufacturing forgery-proof and visually attractive, optically variable security elements. The method is to allow for producing in particular security elements with two or more different appearances or effects in different colors in a few working steps. In addition, it should ideally be possible to manufacture the security elements with a small layer thickness in order to facilitate introduction in or application to security documents and value documents.

According to the invention, in order to achieve the stated object in a method for manufacturing an optically variable security element, it is provided that B) a carrier is made available, the area extension of which defines a z axis standing perpendicularly thereon, A1) a first embossing lacquer layer is applied to the carrier in an area region, P1) a first relief structure is embossed into the first embossing lacquer layer, A2) a second, dyed embossing lacquer layer is applied to the first embossing lacquer layer, wherein the color effect of the second embossing lacquer layer is different from the color effect of the first embossing lacquer layer, wherein the first relief structure is partially covered by the second, dyed embossing lacquer layer and is partially not covered, P2) a second relief structure which differs from the first relief structure is embossed into the second embossing lacquer layer, so that the first relief structure and the second relief structure are arranged in the z-direction at different height levels with reference to the carrier, and M) a coating is applied to the second relief structure and to a non-covered portion of the first relief structure, so that when viewing the security element, a first color impression is created through the combination of the color effects of at least the first embossing lacquer layer and the color coating, and a second, different color impression is created through the combination of the color effects of at least the first embossing lacquer layer, the second embossing lacquer layer and the color coating.

The first and/or second embossing lacquer layer are applied in step A1) or A2) preferably by means of screen printing, offset printing, flexographic printing or gravure printing. The embossing lacquer of the first and/or second embossing lacquer layer can in particular be a UV lacquer, a thermoplastic lacquer, or a so-called dual cure system, i.e. a combination of a UV lacquer and a thermoplastic lacquer. The second embossing lacquer layer is advantageously applied in step A2) in register with the first relief structure.

After the embossing steps P1) and P2) the first and/or second embossing lacquer layer is cured in advantageous configurations, i.e. in particular when a UV lacquer or a dual cure system is used.

In step M, the coating is applied directly to the two layers of embossing lacquer. In the context of the present description, the phrase "apply to" does not otherwise exclude respectively the presence of intermediate layers between the applied layer and the target object. For example, before the first embossing lacquer layer is applied to the carrier in step A1), other layers can already have been applied to the carrier, for example a glazing color coating. The first embossing lacquer layer is then applied to the carrier supplied with this color coating. The color coating can be applied both to the side of the first embossing lacquer layer and to the opposite side of the carrier.

In step M, the coating is applied simultaneously to the first and (the free portion of) the second relief structure. In a coated region, the applied coating is preferably a full-area coating.

In an advantageous development, the (preferably full area) coating is supplied with recesses after step M). For this purpose, either before step M), a washing ink is printed onto the first and/or second embossing lacquer layer and the washing ink is washed out together with the coating after step M), or after step M), a resist lacquer is applied to the color coating, and the coating is removed by an etching step in the regions not supplied with resist lacquer.

Instead of the above-mentioned resist lacquer, an optionally dyed photoresist can first be applied over the full area and subsequently exposed in certain regions. Depending on the resist employed, the exposed or unexposed regions then dissolve in the etching bath, so that the coating disposed underneath dissolves while the coating regions mantled by the photoresist remain protected from the etching.

The recesses in the coating are preferably configured in the form of characters, patterns or a coding. They advantageously represent negative markings, for example negative writing, which appears particularly when the security element is viewed in transmitted light. The recesses or negative markings fundamentally can be placed at all points of the security element. Depending on the placement and product structure, the recesses or negative markings can produce different color impressions. On the one hand, transparent negative markings are possible, i.e. negative markings that are neither covered by a glazing ink nor by a metallization. On the other hand, colored negative markings can also be produced in which the negative markings are covered by at least one glazing ink.

The coating applied in step M) is also referred to here as a color coating (unless it is clearly transparent). The coating applied in step M) is preferably formed by means of a metallization (chromatic or achromatic) or a thin-film structure containing a metal layer. The metallization can represent, for example, a layer of aluminum, silver or an alloy, for example of copper and aluminum. In particular, color-shifting thin-film structures are conceivable as thin-film structures, in particular with absorber-dielectric-absorber or reflector-dielectric-absorber as the layer sequence, for example with silicon and aluminum or chromium partial layers.

The color coating can also be formed by a glazing ink with an underlying metallic mirror coating, for example of aluminum. A luminescent ink, in particular a fluorescent ink with a metallic mirror coating, is also conceivable as the color coating. Finally, the color coating can also be formed by a nanoparticle ink, such as gold-blue particles, various effect pigments, color-shifting pigments or super silver.

Concerning the term "color", a distinction is usually made between chromatic colors and achromatic colors, with chromatic colors not only being characterized by their brightness, but also by their hue and saturation. Achromatic colors are white, black and gray, and also the silvery metallic colors, for example the color of a reflective aluminum or silver layer, are considered as achromatic colors in the context of this application.

In order to also be able to include colorless layers, a further distinction is made in the context of this description between "color" and "color effect", the more general term color effect encompassing both color and colorlessness. A colored or dyed layer is a layer with the color effect of a chromatic ink (for example a red glazing layer) or that of an achromatic ink (for example a silvery lustrous aluminum layer). A colorless layer has no color, but its colorlessness still defines a color effect.

Finally, the term "color impression" is employed for the overall color impression produced by one or more layers. Thus, the layers (in the non-covered but coated portion) produce a first color impression, which is created by the combination of the color effect of at least the first embossing lacquer layer and the color effect of the color coating. A covered portion produces a second, different color impression due to the color effects of at least the first embossing lacquer layer, the second embossing lacquer layer and the color coating. Concretely, for example, the combination of a red glazing layer (red color effect) with an underlying metallization (achromatic color effect) produces a red lustrous color impression, or the combination of a blue glazing layer (blue color effect) with a transparent, colorless layer (colorless color effect) and an underlying metallization (achromatic color effect) produces a blue lustrous color impression.

In the following, the portion of the first relief structure covered by the second embossing lacquer layer is sometimes also referred to in simplifying manner as the covered region. As will be described in more detail later with regard to various embodiments, a covered portion can be an area region or can be present in an area region as grid elements. In addition, several covered portions can preferably be present in a security element.

In a preferred embodiment, the first embossing lacquer layer is colorless, while the second embossing lacquer layer is dyed with a glazing chromatic ink or achromatic ink. However, other configurations are also advantageous in which one or both embossing lacquer layers are dyed with a glazing ink, a luminescent ink or a nanoparticle ink. The condition here is only that the color effects of the first and second embossing lacquer layers differ from one another.

In an advantageous further development of the method, it is provided that a further color coating, in particular a glazing color coating, is applied to the side of the carrier opposite the embossing lacquer layers, or between the carrier and the first embossing lacquer layer. This makes it possible to produce a multiplicity of color combinations when viewing the security element. In particular, a first color impression is produced in the non-covered, coated portion through the combination of the color effects of the further color coating, the first embossing lacquer layer and the above-mentioned coating, and in the covered portion (covered region) through the combination of the color effects of the further color coating, the first embossing lacquer layer, the second embossing lacquer layer and the above-mentioned coating.

In a particularly preferred configuration, the first and/or second relief structure are formed by micromirror arrangements with directed micromirrors, in particular with planar mirrors, concave mirrors and/or Fresnel-like mirrors. The lateral dimensions of the micromirrors are advantageously below 20 μm, preferably below 10 μm.

The first and the second color impression are perceptible separately from one another by the viewer; in particular perceptible separately from one another in dependence on the viewing angle and/or in certain regions. The micromirrors of the first and/or the second relief structure are preferably adapted to produce only one of the two color impressions for the viewer in an effect region, depending on the viewing angle. The micromirrors of the first and/or the second relief structure are alternatively or additionally adapted to produce the two color impressions in two (adjacent or separate) area regions. In the present relief structures, each of the micromirrors is aligned with a predetermined spatial alignment (azimuth angle and inclination angle). The alignment is adapted to a motif and to a viewing angle dependency of the motif. A viewing angle dependency can effect a movement effect, a three-dimensional impression or a motif change for a motif in the (respective) area region.

A transparent carrier is advantageously made available as the carrier, or the carrier is detachably connected to the first embossing lacquer layer in order to make possible viewing the security element from the side of the first embossing lacquer layer. In the case of a transparent carrier, viewing can take place through the carrier; a non-transparent carrier must be detached for viewing from the side of the first embossing lacquer layer, for example after the security element has been transferred to a target substrate. The transparent carrier is advantageously colorlessly transparent, but it can also be dyed in a glazing manner in order to produce an additional color effect.

In an advantageous variant of the invention, the second embossing lacquer layer is applied at least in a partial region in the form of a regular or irregular grid with grid elements and grid spaces, wherein the dimensions of the grid elements and/or grid spaces at least in one direction are between 20 μm and 200 μm, preferably between 60 μm and 150 μm, in particular between 80 μm and 120 μm.

In an advantageous embodiment, the grid elements and grid spaces of the grid have the same shape and preferably also the same size. The grid elements and/or the grid spaces can in particular be formed by strip-shaped, square, triangular or other polygonal elements, but can also have irregular shapes. The grid itself can be regular, i.e. have a regular arrangement of grid elements and grid spaces, but can also be an irregular grid, for example a stochastic grid, in which the grid elements and/or grid spaces have irregular spacings and/or sizes and/or shapes. The area coverage of the grid by the grid elements is advantageously between 30% and 70%, preferably between 40% and 60%, in particular approximately at 50%.

Alternatively or in addition to the grid mentioned, an effect region is formed in which a non-covered portion forms (at least) a first area region with the first relief structure and a covered portion forms (at least) a second area region with the second relief structure. The dimensions of the area regions are advantageously above the resolution limit of the naked eye, so that each area region can be recognized without aids.

As an alternative or in addition to the aforementioned grid and/or the aforementioned area regions, an effect region is formed in which the second embossing lacquer layer is applied in partial regions which have lateral dimensions of more than 140 and/or in which the second embossing lacquer layer is applied with recesses that have lateral dimensions of more than 140 μm. The lateral dimensions of at least one partial region and/or at least one recess are preferably amount to more than 250 preferably more than 500 μm and in particular more than 1 mm. In the case of micromirror arrangements or other relief structures that are formed from small relief elements, the partial regions or recesses of the effect region therefore typically extend over many micromirrors or relief elements. The aforementioned dimensions can be exceeded by the partial regions and/or recesses only in a lateral direction; however, advantageously, the recesses are larger than the aforementioned dimensions in every lateral direction. Particularly advantageously, the dimensions are above the resolution limit of the naked eye, so that the areal region of the partial regions and/or recesses can be recognized without aids.

The two relief structures advantageously, in dependence on the viewing angle, make available a color change for an unchanged motif or make available a color change together with a motif change. The motifs of the two relief structures can vary in particular with regard to shape (for example head, apple or number), movement (static to moved or moved to static, with linear, rotating and/or pumping movement) and/or three-dimensionality (2D to 3D or differently three-dimensional with a positively or negatively curved appearance and/or floating in front of or behind a plane) of the motif.

In an advantageous embodiment it is provided that the first relief structure produces a first motif that is visible from a first viewing angle range with a first color impression, which is created by the combination of the color effects of at least the first embossing lacquer layer and the color coating, and that the second relief structure produces a second motif that is visible from a second viewing angle range with a second, different color impression, which is created by the combination of the color effects of at least the first embossing lacquer layer, the second embossing lacquer layer and the color coating, wherein the first and the second viewing angle range do not overlap. Upon tilting, the security element then shows a binary color and effect change without overlap region. The two viewing angle ranges advantageously border one another or are only separated by an angular distance of a few degrees, so that the associated image impressions are practically seamlessly switched for the viewer.

In another, likewise advantageous embodiment, it is provided that the first relief structure produces a first movement motif with a first color impression and the second relief structure produces a second movement motif with a second, different color impression, wherein, upon tilting the security element, the first and second movement motif move in a manner offset to one another or in a manner against one another and, in an overlap position in which both movement motifs are visible, cross each other and/or move consecutively through the same portion of the common region. Here, too, the first color impression arises from the combination of the color effects of at least the first embossing lacquer layer and the color coating, and the second color impression arises from the combination of the color effects of at least the first embossing lacquer layer, the second embossing lacquer layer and the color coating.

The proposed method allows the manufacture of security elements of the type mentioned at the beginning with only a few working steps. The described layer structure also makes it possible to produce security elements with a total thickness of less than 45 μm, which are ideal for use in banknotes and other value documents.

BRIEF DESCRIPTION OF THE DRAWINGS

Further embodiment examples as well as advantages of the invention will be explained hereinafter with reference to the figures, in the representation of which a rendition that is true to scale and proportion has been dispensed with in order to increase clarity.

There are shown.

DETAILED DESCRIPTION OF VARIOUS EMBODIMENTS

Figure 1:
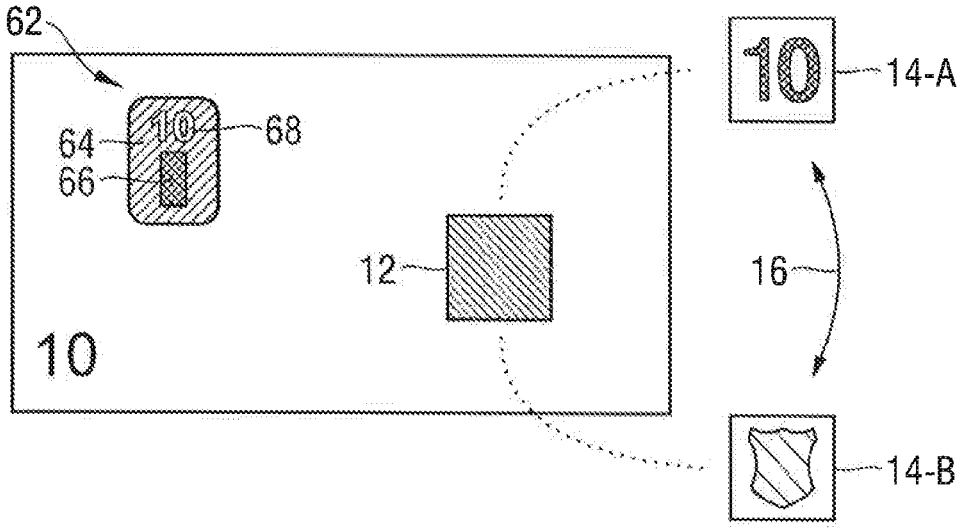
FIG. 1 a schematic representation of a banknote with two security elements according to the invention, FIG. 2 schematically a detail of the first security element of FIG. 1 in cross section, FIG. 3, including FIGS. 3(*a*) to 3(*d*), intermediate steps of the manufacture of the security element of FIG. 2, FIG. 4, including FIGS. 4(*a*) to 4(*d*) some concrete advantageous embodiments of the grid of the embossed structure of the security element of FIG. 2 in plan view, FIG. 5 schematically a detail of the second security element of FIG. 1 in cross section, FIG. 6, including FIGS. 6(*a*) to 6(*f*) intermediate steps of the manufacture of the security element of FIG. 5, and FIG. 7 a variant of the security element of FIG. 2 in cross section.

The invention will now be explained by the example of security elements for banknotes. FIG. 1 shows a schematic representation of a banknote 10 with two optically variable security elements 12 and 62, each of which is configured in the form of an adhesively bonded transfer element. It goes without saying, however, that the invention is not limited to transfer elements and banknotes but can be used for all types of security elements, for example for labels on goods and packagings or for securing documents, identity documents, passports, credit cards, health cards and the like. In the case of banknotes and similar documents, in addition to transfer elements, security threads or security strips can also be considered, for example. The two security elements 12, 62 of FIG. 1 are themselves configured to be very flat, but nevertheless convey a three-dimensional impression to the viewer.

The first security element 12 in addition to the three-dimensional appearance shows a binary color and effect change upon tilting the banknote 10, in which, from a first viewing direction, a first motif 14-A appears that apparently bulges out of the plane of the banknote 10, for example a curved representation of the value number "10", with a first, for example silvery lustrous, color impression. From a second viewing direction, a second motif 14-B shows that appears to bulge out of the plane of the banknote 10, for example a curved representation of a coat of arms with a second color impression, for example a lustrous red color impression.

When tilting 16 the banknote 10 or a corresponding change in the viewing direction, the appearance of the security element 12 suddenly switches from the first to the second appearance or upon tilting back from the second to the first appearance. The change of the motif and the color takes place simultaneously and without an intermediate or transitional stage in which both motifs or colors would be visible at the same time, or a motif would be visible in the color of the other motif. The appearance therefore switches seamlessly between two appearances 14-A, 14-B and is therefore referred to as a binary color and effect change.

Figure 2:
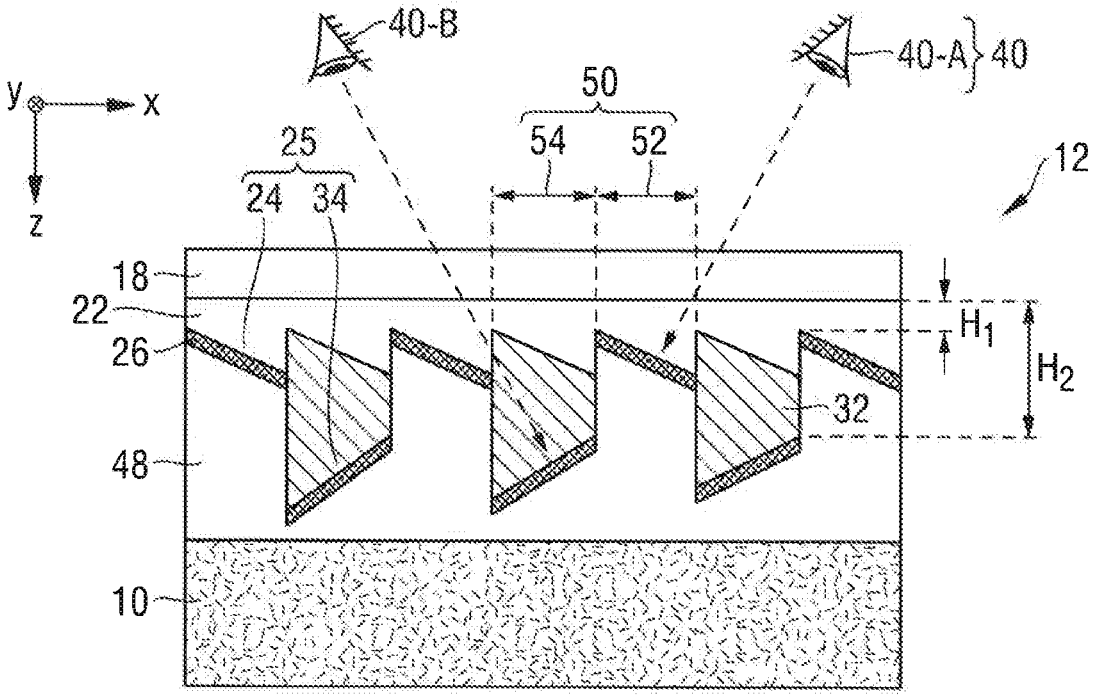

The particular structure and the manufacture according to the invention of the first security element 12 will now be explained in more detail with reference to FIGS. 2 and 3, wherein FIG. 2 schematically shows a section of the security element 12 applied to the banknote 10 in cross section and FIG. 3 shows various intermediate steps of the manufacture of the security element 12.

The security element 12 contains a flat, transparently colorless carrier 18, the area extension of which defines an x-y plane and a z-axis standing perpendicular thereon. A multicolored reflective area region is arranged on the carrier 18, said region containing an embossed structure region 25 with two nested micromirror embossings 24, 34 at two different height levels. A first embossed region 24 is given by micromirror embossings, the base areas of which are at a height $H_1$ above the carrier 18. A second embossed region 34 is given by micromirror embossings, the base areas of which are at a height $H_2>H_1$ above the carrier 18. The height as well as the direction of the positive z-axis is always measured starting from the carrier 18. Since the security element 12 is intended to be viewed from the lower side, i.e. the side of the carrier 18, the z-axis in the representation of FIG. 2 extends away from the carrier downwards.

The micromirror embossings 24, 34 (hereinafter also referred to as micromirror arrangements) each contain a multiplicity of micromirrors inclined relative to the x-y plane, the local inclination angles of which are selected so that the relief structures of the micromirror embossings 24, 34, in interaction with the color effects of the embossing lacquer layers 22, 32 and the color effect of a uniform color coating 26, produce a desired optical appearance.

Concretely, the inclination angles of the micromirrors in the embodiment example are selected so that the micromirror arrangement 24 produces the curved representation of the value number "10" in a viewing angle range of +5° to +20° (viewing position 40-A) with reference to the surface normal, and the micromirror arrangement 34 produces the curved representation of the coat of arms in a viewing angle range of −5° to −20° (viewing position 40-B). In the embodiment example, the micromirrors of the micromirror embossings 24, 34 themselves have a lateral dimension of $10\times10\ \mu m^2$ and a maximum height h of 3.5 μm. The height offset $\Delta H=H_2-H_1$ with reference to the base area can be for example $\Delta H=6\ \mu m$.

As explained in more detail in connection with FIG. 3, the micromirror arrangements 24, 34 are produced by embossing two different embossing lacquer layers 22, 32 with different color effects. While the embossing lacquer layer 22 in which the micromirror arrangement 24 is embossed is transparently colorless, the embossing lacquer layer 32 in which the micromirror arrangement 34 is embossed is dyed in a glazing red. Both micromirror arrangements 32, 34 are supplied with a uniform color coating 26, which in the embodiment example is formed by a metal coating, concretely by a thin, vapor-deposited aluminum layer, which has a silvery metallic, and thus achromatic color effect.

The desired visual contrast of the micromirror arrangements 24, 34 from the viewing positions 40-A or 40-B of the viewer 40 is created by the interaction of the different color effects of the embossing lacquer layers 22, 32 with the color effect of the uniform color coating 26.

In the embodiment example of FIG. 2, the two micromirror arrangements 24, 34 are nested in one another in the form of a regular grid 50 in the entire area region of the security element 12, wherein only the micromirror embossings 24 of the height level $H_1$ are present in the first grid regions 52, while in the complementary second grid regions 54, the covered region, the second embossing lacquer layer 32 with the micromirror embossings 34 are additionally present at the height level $H_2$ and are optically effective. Concretely, the grid regions 52, 54 in the embodiment example form a checkerboard pattern in which each field, i.e. each grid region 52, 54, has a dimension of $100\ \mu m\times100\ \mu m$. Since the micromirrors are generally significantly smaller, here for example have an edge length of only 10 μm, the grid 50, unlike in the simplified schematic representation of FIGS. 2 and 3, is generally not congruent with the grid of the micromirrors of the micromirror arrangements 24, 34.

Overall, the described arrangement results in the desired appearances. Since the carrier 18 and the first embossing lacquer layer 22 are configured to be transparently colorless, the micromirror arrangement 24 with the silvery metallic appearance of the aluminum layer 26 which shows the curved representation 14-A of the value number "10" is visible from the viewing position 40-A. Due to the glazing red dyeing of the second embossing lacquer layer 32 and the underlaying of the second embossing lacquer layer with the aluminum layer 26, the coat of arms 14-B appears with a lustrous red appearance from the viewing position 40-B.

The manufacture of the security element 12 according to the invention will now be described in more detail with reference to FIG. 3, wherein (a) to (d) each show intermediate steps of the manufacture of the security element.

First, with reference to FIG. 3 (*a*), a transparent carrier 18, for example a transparently colorless PET foil, is made available and supplied with a first, transparent and colorless embossing lacquer layer 22. The micromirror embossing 24, which produces the representation 14-A of the value number "10", is embossed into the first embossing lacquer layer 22 with an embossing tool (not shown). When using a UV embossing lacquer, the embossing lacquer layer 22 is subsequently cured.

A second embossing lacquer layer 32 dyed in a glazing red is then printed onto the first embossing lacquer layer 22 in a regular grid 50, as shown in FIG. 3 (*b*), with a printing cylinder (not shown). The grid 50 is configured in the form of grid elements 54 and grid spaces 52 and corresponds, for example, to the checkerboard pattern described above with field dimensions of 100 μm×100 μm. In this embodiment example, the grid elements 54 produce the covered portion or the covered region mentioned above, in which the second embossing lacquer layer 32 is applied to the first embossing lacquer layer 22.

The second embossing lacquer layer 32 is then supplied with the micromirror embossing 34, which shows the representation of the coat of arms 14-B, as shown in FIG. 3 (*c*), with an embossing tool (not shown). When using a UV embossing lacquer, the embossing lacquer layer 32 is subsequently cured.

To the overall relief structure 25 formed in this manner, which is formed by the first relief structure 24 of the first embossing lacquer layer 22 and the second relief structure 34 of the second embossing lacquer layer 32, there is then applied a full-area metal coating 26, for example an aluminum layer, as shown in FIG. 3 (*d*). Finally, the structure side of the metalized overall relief structure 25 is supplied with a lacquer coating 48 and, possibly, further coatings, and the security element 12 is thereby completed.

A substantial advantage of the manufacturing method according to the invention is the very small number of working steps required in comparison to conventional methods. The proposed layer structure also results in very small product thicknesses of less than 45 μm, which is of great importance in particular for the use of the security elements in banknotes and other value documents. In addition, with the method described, the security elements can also be supplied with transparent or colored negative markings in a simple manner, as explained in more detail elsewhere.

Figure 4:
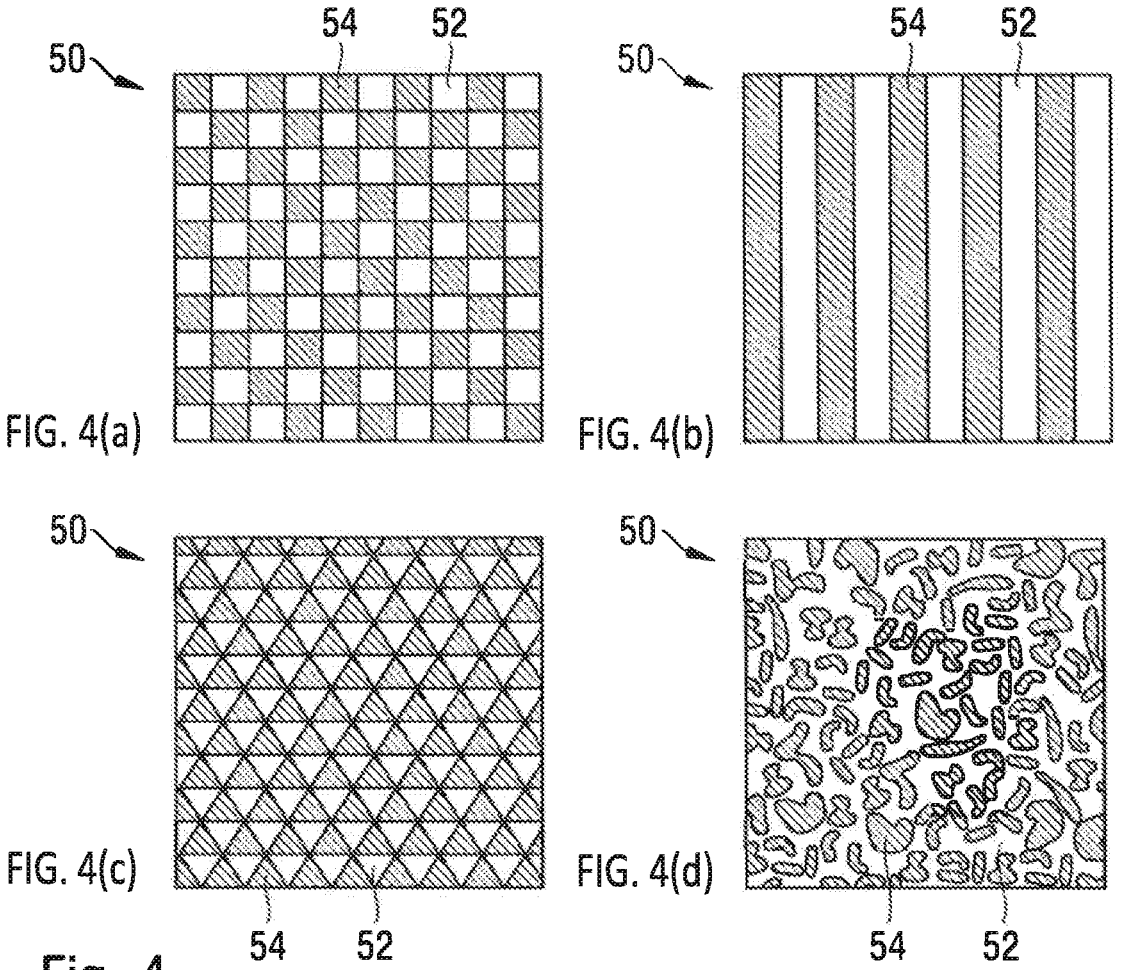

FIG. 4 shows some concrete advantageous configurations of the grid 50 of the second embossing lacquer layer 32 in plan view. The grid elements 54 are each represented with a hatching and the grid spaces 52 are each represented without hatching. FIG. 4 (*a*) shows a grid 50 as employed in FIGS. 2 and 3, in which the grid elements 54 and the grid spaces 52 form a checkerboard pattern. The dimensions of the grid regions are advantageously between 20×20 $\mu m^2$ and 140×140 $\mu m^2$, in particular between 20×20 $\mu m^2$ and 60×60 $\mu m^2$; the area coverage is 50%. If an area coverage that deviates from 50% is to be produced, part of the grid elements 54 can be omitted or part of the grid spaces 52 can be occupied by grid elements.

In this, but also in the configurations described in the following, the area coverage of the grid with grid elements 54 is preferably between 30% and 70%, in particular between 40% and 60%. The brightness of the appearances produced in each case can be adjusted as desired by the area coverage of the first and second grid regions.

FIG. 4 (*b*) shows a grid 50 with alternately arranged strip-shaped grid elements 54 and grid spaces 52. The width of the grid regions is advantageously between 20 μm and 140 μm, in particular between 20 μm and 60 μm. The length of the grid regions is arbitrary and can be several millimeters or even some centimeters. The area coverage can easily be adjusted via the relative width of the grid elements and grid spaces.

The grid elements and grid spaces can also have other polygonal shapes or irregular shapes. By way of example, FIG. 4 (*c*) shows an embodiment in which the grid elements 54 and grid spaces 52 of the grid 50 are formed by triangles. In the grid 50 of FIG. 4 (*d*), the grid elements 54 and grid spaces 52 are formed by irregular shapes. The grid elements and/or grid spaces can form a coherent structure, as shown for example of FIG. 4 (*d*) for the grid spaces 52.

Returning to the representation in FIG. 1, the second security element 62 transferred to the banknote 10 is also very flat itself, but nevertheless conveys to the viewer the three-dimensional impression of a motif 64 appearing to bulge out of the plane of the banknote 10, which appears with a first color impression. The motif 64 can represent, for example, a value number, a portrait or another graphic motif. Within the motif 64 with the first color impression, a movement effect with a second color impression is visible in a partial region 66. For example, upon tilting the banknote 10, a bright bar can move up and down along the partial region 66 and produce a so-called rolling bar effect. As a substantial special feature, the regions of different color impressions (first and second color impression) and different effects (three-dimensional motif or running bar) therein are disposed in exact mutual register. This registration is therefore also referred to as color-to-effect registration in the following.

In addition, the security element 62 contains a negative writing 68 in the form of the value number "10", which is formed by a transparent partial region of the security element 62. If the security element 62 is arranged over an opaque region of the banknote 10, the surface of the banknote, for example the white banknote paper, becomes visible there. If the security element 62 is arranged over a window region of the banknote, the negative writing 68 forms a transparent see-through region in the security element 62, which lights up brightly when viewed in transmitted light.

Figure 5:
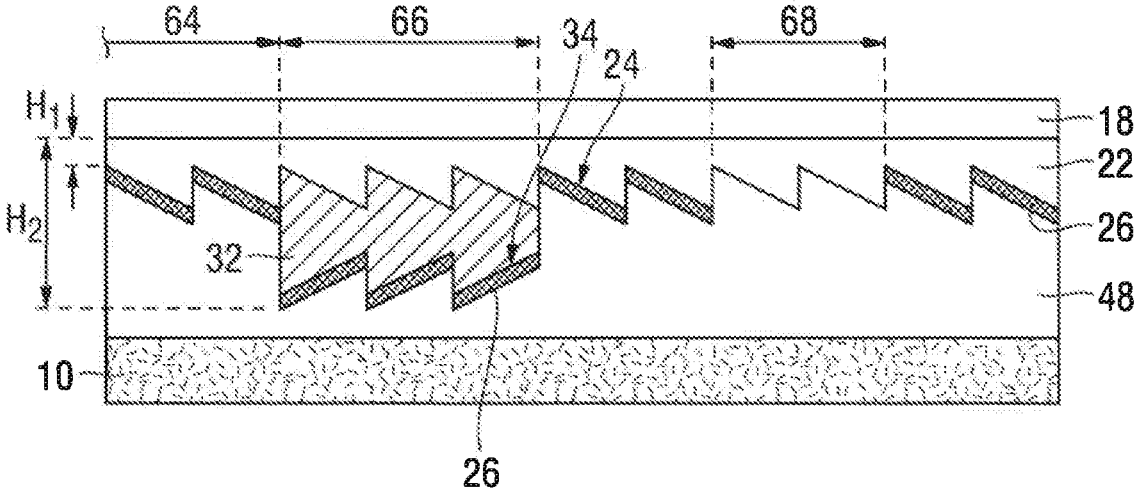

The special structure and the manufacture according to the invention of the security element 62 will now be explained in more detail with reference to FIGS. 5 and 6, wherein FIG. 5 schematically shows a detail of the security element 62 applied to the banknote 10 in cross section and FIG. 6 shows various intermediate steps of the manufacture of the security element 62.

The security element 62 is constructed similarly to the security element 12 already described in connection with FIG. 2, so that elements that correspond to one another are each designated with the same reference numerals. The security element 62 contains a flat, transparently colorless carrier 18, the area extension of which defines an x-y plane and a z-axis standing perpendicularly thereon. On the carrier 18 there is arranged a multicolored reflective area region which contains an embossed structure region with micromirror embossings with two different height levels.

Like in FIG. 2, a first embossed region 24 is given by micromirror embossings, the base areas of which are at a height $H_1$ above the carrier 18, while a second embossed region is given by micromirror embossings 34, the base areas of which are at a height $H_2>H_1$ above the carrier 18. The micromirror embossings or micromirror arrangements 24, 34 each contain, like in the embodiment example of FIG. 2, a multiplicity of micromirrors inclined relative to the x-y plane, the local inclination angles of which are selected so that the relief structures of the micromirror embossings 24, 34, in interaction with the color effects of the embossing lacquer layers 22, 32 and the color effect of a uniform color coating 26, produce a desired optical appearance.

Concretely, the inclination angles of the micromirrors in the embodiment example are selected such that the micromirror arrangements 24, 26 produce the bulging three-dimensional impression of the motif 64 and the rolling bar effect of the partial region 66. The sizes and heights of the micromirrors can be selected like in the embodiment example of FIG. 2.

While the embossing lacquer layer 22 in which the micromirror arrangement 24 is embossed is transparently colorless, the embossing lacquer layer 32 in which the micromirror arrangement 34 is embossed is dyed in a glazing blue. Both micromirror arrangements 32, 34 are supplied with a uniform color coating 26, which in the embodiment example of FIG. 5 is formed by a metal coating, concretely by a thin, vapor-deposited silver layer that has a silvery metallic and thus achromatic color effect.

The desired visual contrast of the micromirror arrangements 24, 34 from the different viewing positions of the viewer is created by the interaction of the different color effects of the embossing lacquer layers 22, 32 with the color effect of the uniform color coating 26.

In the embodiment example of FIG. 5, the two micromirror arrangements 24, 34 are each arranged directly adjacent to one another in the area region of the security element 62. The partial region 66 is formed, for example, by a 5 mm wide and 2 cm long curving strip within a 2.5×2.5 $cm^2$ large area region 64. While in the partial region 66, which represents the above-mentioned covered region, the viewer looks through the glazing blue embossing lacquer layer 32 at the micromirror arrangement 34 with the silver layer 26 disposed at the height level $H_2$, the visual impression in the region 64, i.e. outside the covered region 66, is determined by the micromirror arrangement 24 disposed at the height level $H_1$ and thus only by the color effect of the silver layer 26.

In the region 64, the viewer therefore perceives the silvery lustrous motif 64 produced by the micromirror arrangement 24, while within the partial region 66 the blue-metallic rolling bar effect appears, in which, upon tilting the banknote 10, a blue reflective bar appears to run back and forth along the curving strip. Since the height difference between the two micromirror arrangements 24, 34 is in the range of a few micrometers, it is imperceptible to the viewer, so that the two differently colored motifs and the different effects 64, 66 appear to be arranged next to one another in exact register.

The security element 62 additionally has a smaller partial region 68 in the region 64, which is configured in the form of the value number "10" and in which the color coating 26 is omitted. Due to the lack of color coating and the transparency of the other layers present in the partial region 68, a negative marking is created there in the security element 62. Depending on the arrangement of the security element, the partial region 68 forms a transparent see-through window in the banknote or it reveals the view of the surface of the banknote.

The manufacture of the security element 62 according to the invention will now be described in more detail with reference to FIG. 6, wherein (a) to (f) each show intermediate steps in the manufacture of the security element.

First, with reference to FIG. 6 (*a*), a transparent carrier 18, for example a transparently colorless PET foil, is made available and supplied with a first, transparent and colorless embossing lacquer layer 22. The micromirror embossing 24, which produces the motif 64 of the security element 62, is embossed into the first embossing lacquer layer 22 with an embossing tool (not shown). When using a UV embossing lacquer, the embossing lacquer layer 22 is subsequently cured.

A second embossing lacquer layer 32 dyed in a glazing blue is printed onto the first embossing lacquer layer 22 in the desired covered region 66 of the running bar, as shown in FIG. 6 (*b*), with a printing cylinder (not shown). With reference to FIG. 6 (*c*), the second embossing lacquer layer 32 is then supplied with the micromirror embossing 34 which produces the rolling bar effect using an embossing tool (not shown). When using a UV embossing lacquer, the embossing lacquer layer 32 is subsequently cured.

In order to produce the negative writing, washing ink 70 is printed on in the partial regions 68 which are to be demetallized subsequently, as shown in FIG. 6 (*d*).

To the overall structure produced in this manner, which is formed by the first relief structure 24 of the first embossing lacquer layer 22, the second relief structure 34 of the second embossing lacquer layer 32 present in the overlap region 66 and the washing ink 70 printed in the partial regions 68, there is then applied a uniform, full-area metal coating 26, for example, the mentioned silver layer, as shown in FIG. 6 (*e*).

Subsequently, the washing ink 70 is washed out together with the portion of the metal coating 26 disposed on the washing ink and there is obtained the area region 68 demetallized in certain regions, represented in FIG. 6 (*f*). Finally, the structure side of the partially metalized relief structure is supplied with a lacquer coating 48 and, possibly, further coatings, and the security element 62 is thereby completed. The color variety of the appearances of the two micromirror embossings can be further increased within the scope of the invention. For illustration, FIG. 7 shows a modification of the embodiment example of FIG. 2, in which both the motif 14-A (value number "10") and the coat of arms motif 14-B appear with a chromatic impression. For this purpose, in the case of the security element 80, in addition to the elements already described in FIG. 2, on the side of the carrier 18 facing away from the micromirror embossings 24, 34, a continuous glazing ink layer 82 is provided.

When viewed, the motif 14-A of the micromirror embossing 24 then appears lustrous with a first chromatic color, due to the combined effect of the ink layer 82 and the metallization 26, and the motif 14-B of the micromirror embossing 34 appears lustrous with a second chromatic color, due to the combined effect of the ink layer 82, the dyed embossing lacquer layer 32 and the metallization 26, said second chromatic color being created by subtractive color mixture of the colors of the ink layer 82 and the embossing lacquer layer 32. If, for example, the embossing lacquer layer 32 is dyed in glazing cyan and the ink layer 82 is dyed in glazing yellow, then the motif 14-A appears with a yellow lustrous color and the motif 14-B appears with a green lustrous color due to the subtractive color mixture of cyan and yellow.

Alternatively, the ink layer 82 can also be provided between the carrier 18 and the first embossing lacquer layer 22. Instead of providing an additional ink layer 82, a first embossing lacquer layer 22 dyed in glazing manner or a carrier foil 18 dyed in glazing manner can also be employed. These measures can also increase the color variety of the appearances.

Even if the embodiment examples were concretely described with metal layers and glazing chromatic inks for illustration purposes, it is understood that the other inks mentioned above can also be used for the color coating 26 and the embossing lacquer layers 22, 32.

The invention claimed is:

1. A method for manufacturing an optically variable security element, in which a carrier is made available, the area extension of which defines a z axis standing perpendicularly thereon, wherein:

(A1) a first embossing lacquer layer is applied to the carrier in an area region, (P1) a first relief structure is embossed into the first embossing lacquer layer, (A2) a second, dyed embossing lacquer layer is applied to the first embossing lacquer layer, wherein a color effect of the second embossing lacquer layer differs from a color effect of the first embossing lacquer layer, and wherein the first relief structure is partially covered by the second, dyed embossing lacquer layer and is partially not covered, (P2) into the second embossing lacquer layer there is embossed a second relief structure, which differs from the first relief structure, so that the first relief structure and the second relief structure in the z-direction are arranged at different height levels with reference to the carrier, and (M) a coating is applied to a non-covered portion of the first relief structure and to the second relief structure, so that for a viewer of the security element a first color impression is created through the combination of at least the color effects of the first embossing lacquer layer and the coating, and a second, different color impression is created through the combination of the color effects of at least the first embossing lacquer layer, the second embossing lacquer layer and the coating, wherein the coating is supplied with recesses after step (M), by either before step (M) printing a washing ink onto the first and/or second embossing lacquer layer and washing out the washing ink together with the coating after step (M), or after step (M) applying a resist lacquer to the coating and removing the coating in the regions not supplied with resist by an etching step.

2. The method according to claim 1, wherein the first and/or second embossing lacquer layer is applied by means of screen printing, offset printing, flexographic printing or gravure printing.

3. The method according to claim 1, wherein the second embossing lacquer layer is applied in register with the first relief structure in step (A2).

4. The method according to claim 1, wherein the coating is formed by a, chromatic, color coating, by a metallization with a glazing ink layer, a chromatic metallization or a thin-film structure containing a metal layer.

5. The method according to claim 1, wherein the first embossing lacquer layer is colorless, and the second embossing lacquer layer is dyed with a glazing chromatic ink or achromatic ink.

6. The method according to claim 1, wherein on the side of the carrier opposite the embossing lacquer layers, or between the carrier and the first embossing lacquer layer there is applied a further color coating, a glazing color coating.

7. The method according to claim 1, wherein the first and/or second relief structure are formed by micromirror arrangements with directional micromirrors, wherein the lateral dimensions of the micromirrors are advantageously below 20 μm.

8. The method according to claim 1, wherein the second embossing lacquer layer is applied in partial regions which have lateral dimensions of more than 140 μm, and/or in which the second embossing lacquer layer is applied with recesses that have lateral dimensions of more than 140 μm.

9. The method according to claim 8, wherein the lateral dimensions of at least a partial region and/or at least one recess are more than 250 μm.

10. The method according to claim 1, wherein the first and the second color impression are perceivable separately from one another, are perceivable separately from one another in dependence on the viewing angle and/or in certain regions.

11. The method according to claim 1, wherein the two relief structures, depending on the viewing angle, make available a color change for an unchanged motif or make available a color change together with a motif change, wherein the motifs of the two relief structures differ with regard to shape, movement and/or dimensionality of the motif.

12. The method according to claim 1, wherein the first relief structure produces a first motif that is visible from a first viewing angle range with a first color impression, which is created through the combination of the color effects of the first embossing lacquer layer and the color coating, and that the second relief structure produces a second motif that is visible from a second viewing angle range with a second, different color impression, which is created through the combination of the color effects of the first embossing lacquer layer, the second embossing lacquer layer and the color coating, wherein the first and the second viewing angle ranges do not overlap.

13. The method according to claim 1, wherein the first relief structure produces a first movement motif with a first color impression and the second relief structure produces a second movement motif with a second, different color impression, wherein the first and second movement motive, upon tilting the security element move in a manner offset to one another or in a manner against one another and, in an overlap position in which both movement motifs are visible, cross each other and/or move consecutively through the same portion of the common region.

14. A method for manufacturing an optically variable security element, in which a carrier is made available, the area extension of which defines a z axis standing perpendicularly thereon, wherein:

(A1) a first embossing lacquer layer is applied to the carrier in an area region, (P1) a first relief structure is embossed into the first embossing lacquer layer, (A2) a second, dyed embossing lacquer layer is applied to the first embossing lacquer layer, wherein a color effect of the second embossing lacquer layer differs from a color effect of the first embossing lacquer layer, and wherein the first relief structure is partially covered by the second, dyed embossing lacquer layer and is partially not covered, (P2) into the second embossing lacquer layer there is embossed a second relief structure, which differs from the first relief structure, so that the first relief structure and the second relief structure in the z-direction are arranged at different height levels with reference to the carrier, and (M) a coating is applied to a non-covered portion of the first relief structure and to the second relief structure, so that for a viewer of the security element a first color impression is created through the combination of at least the color effects of the first embossing lacquer layer and the coating, and a second, different color impression is created through the combination of the color effects of at least the first embossing lacquer layer, the second embossing lacquer layer and the coating, wherein the coating is formed by an achromatic coating, by a metallization, as an achromatic color coating, or by a transparent reflection-increasing layer.

15. A method for manufacturing an optically variable security element, in which a carrier is made available, the area extension of which defines a z axis standing perpendicularly thereon, wherein:

(A1) a first embossing lacquer layer is applied to the carrier in an area region, (P1) a first relief structure is embossed into the first embossing lacquer layer, (A2) a second, dyed embossing lacquer layer is applied to the first embossing lacquer layer, wherein a color effect of the second embossing lacquer layer differs from a color effect of the first embossing lacquer layer, wherein the second embossing lacquer layer is applied at least in a partial region in the form of a regular or irregular grid with grid elements and grid spaces, wherein the dimensions of the grid elements and/or grid spaces are at least in one direction between 20 μm and 200 μm, and wherein the first relief structure is partially covered by the second, dyed embossing lacquer layer and is partially not covered, (P2) into the second embossing lacquer layer there is embossed a second relief structure, which differs from the first relief structure, so that the first relief structure and the second relief structure in the z-direction are arranged at different height levels with reference to the carrier, and (M) a coating is applied to a non-covered portion of the first relief structure and to the second relief structure, so that for a viewer of the security element a first color impression is created through the combination of at least the color effects of the first embossing lacquer layer and the coating, and a second, different color impression is created through the combination of the color effects of at least the first embossing lacquer layer, the second embossing lacquer layer and the coating.

* * * * *